US008262033B2

(12) United States Patent
Pease

(10) Patent No.: US 8,262,033 B2
(45) Date of Patent: Sep. 11, 2012

(54) DERAIL ASSEMBLY

(75) Inventor: Ronald G. Pease, Hickory Hills, IL (US)

(73) Assignee: Western-Cullen-Hayes, Inc., Chicago, IL (US)

( * ) Notice: Subject to any disclaimer, the term of this patent is extended or adjusted under 35 U.S.C. 154(b) by 147 days.

(21) Appl. No.: 12/909,477

(22) Filed: Oct. 21, 2010

(65) Prior Publication Data

US 2012/0097802 A1 Apr. 26, 2012

(51) Int. Cl.
*B61L 19/02* (2006.01)

(52) U.S. Cl. ..... 246/163; 104/261

(58) Field of Classification Search ..... 246/163; 104/261–269

See application file for complete search history.

(56) References Cited

U.S. PATENT DOCUMENTS

| | | | | |
|---|---|---|---|---|
| 1,464,606 | A * | 8/1923 | Hayes | 246/163 |
| 1,464,607 | A * | 8/1923 | Hayes | 246/163 |
| 1,627,092 | A * | 5/1927 | Hayes | 246/163 |
| 2,829,246 | A * | 4/1958 | Hayes | 246/163 |
| 4,165,060 | A * | 8/1979 | Meyer | 246/163 |
| 6,105,906 | A * | 8/2000 | Pease et al. | 246/163 |
| 6,178,893 | B1 * | 1/2001 | Pease | 104/261 |
| 6,202,564 | B1 * | 3/2001 | Hart et al. | 104/261 |
| 7,549,611 | B2 * | 6/2009 | Hertel | 246/163 |
| 7,753,317 | B1 * | 7/2010 | Schirmer | 246/163 |
| 7,909,293 | B2 * | 3/2011 | Pease | 246/163 |
| 2008/0023592 | A1 * | 1/2008 | Hertel | 246/163 |
| 2010/0051757 | A1 * | 3/2010 | Pease | 246/163 |
| 2012/0097802 | A1 * | 4/2012 | Pease | 246/163 |

* cited by examiner

*Primary Examiner* — S. Joseph Morano
*Assistant Examiner* — Jason C Smith
(74) *Attorney, Agent, or Firm* — Banner & Witcoff, Ltd.

(57) ABSTRACT

This invention relates to a derail assembly used in the railroad industry for derailing a wheel of an undesirably moving railed vehicle. The invention particularly relates to derailing a moving locomotive having a pilot at the front of the locomotive. The derail may be a single ended derail or a double ended derail. The derail includes a rigid derail plate which is in direct contact with the upper surface of the rail. An upright derail bar is securely mounted on the derail plate and the derail bar is angled outwardly for engaging a wheel of the locomotive or other railway car when moving undesirably for causing a desired derailment. The second derail bar may be provided in the case of a double ended derail. The derail includes longitudinally spaced rigid hooks at opposite ends of the derail to secure one side of the derail to the rail. The opposite side has a clamp mounted on the derail for securing the derail to the rail. A pair of rigid upright members are longitudinally spaced from each other on the underside of the derail plate. An open space is provided between the upright rigid members. A railroad tie is snugly received between the spaced upright rigid members to longitudinally secure the derail against longitudinal movement caused by an undesirably moving railway car or a locomotive.

9 Claims, 5 Drawing Sheets

DERAIL ASSEMBLY

CROSS REFERENCE TO RELATED APPLICATION

This is a utility application relating to U.S. Ser. No. 12/546,868 filed Aug. 25, 2009 entitled Low Profile Derail which was derived from provisional application Ser. No. 61/091,839 filed Aug. 26, 2008. The subject matter of U.S. Publication No. US/2010/0051757A1 (Ser. No. 12/546,868) is incorporated herein by reference.

BACKGROUND OF THE INVENTION

This invention relates to railway safety equipment, namely, derails which are commonly used for derailing railed vehicles including locomotives, railroad cars and the like which may be undesirably moving along railroad tracks normally at a relatively low speed.

There are many types of derails known in the railroad industry which have been used for many years. Certain types of derails are substantially permanently fixed to one rail of a pair of railroad track rails and various methods may be used to move the derail between an operative position and an inoperative position. Some derails are relatively light in weight so as to be portable and some are not movable between operative and inoperative positions.

As disclosed in the related application U.S. Publication 2010/0051757, the railway industry historically requires that the highest point of a derail was not to be more than four inches measured from the top of the rail upon which the derail was affixed. The reason for this requirement was that the pilot must be allowed to have cleared the highest point of the derail so that a heavy locomotive pilot (also known as a "cow catcher") did not sweep, push or knock off the entire derail when the locomotive was undesirably moving at a relatively low speed, possibly up to ten miles per hour. In the event the derail is dislocated out of the operative derail position by the pilot, the derail becomes ineffective and the undesirably moving locomotive may cause serious damage to other locomotives, railway cars or even cause serious injury or death to workers in the area.

Relatively recently the railway industry changed its standards to require that certain derails could not have its highest point be more than three inches above the upper surface of the railroad rail upon which the derail is affixed. Existing derails higher than three inches above the rail can now be unsafe to use in a railroad track area where a heavy locomotive's pilot could dislocate the derail track upon from which it is mounted before the lead wheel of the undesirably moving locomotive could be derailed by the derail. This situation would cause the undesirably moving locomotive to continue moving unsafely rather than allowing the derail to remain in place and cause a safe derailment of the locomotive by engaging the lead wheel of the locomotive.

While the low profile derail of the above mentioned U.S. Publication is very effective, the disadvantages of a derail of the disclosed type is that a one ended deflecting bar is only designed to derail a locomotive or other moving railway car going in only one direction as shown in FIGS. 1 and 3 of the above publication. It is known in the railway industry to provide double ended derails as shown, for example, in FIGS. 9-11 of U.S. Pat. No. 7,549,611, and also in U.S. Pat. No. 6,202,564 as well as in other patents. Such derails may be used to derail a vehicle, including a locomotive, in two directions. In such derails, however, the derail must be moved to another section of the rail for an oppositely moving locomotive since such derails are subject to being longitudinally pushed along the track upon where it has been mounted because there is no foolproof provision to stop such longitudinal movement of the derail along the track. Therefore, known double ended derails are useful to effectively derail any railway car or locomotive but they cannot be left in the same spot on the tract, that is, they must be repositioned to cause a safe derailment for an oppositely moving car or locomotive.

In addition to the desirability of providing a double ended derail assembly to be kept in the same place on a track, regardless of the direction of movement of a car or locomotive, a double ended is desirably used so that a locomotive moving in one direction or another or other railway may be derailed by the derail when the locomotive is undesirably moving along the track in either direction. Such a derail does not need to be repositioned as has been generally required in prior art double ended derails. It is also desirable to provide a low profile derail assembly such as shown in the above Publication.

In the derail industry, it is well known that spaced rails of a railway track can vary significantly in height. For example, in the case of a 75 pound nominal weight per yard of a steel rail, the rail could have an overall height of as high as $4\frac{15}{16}$ inches while another steel rail may have a nominal weight of 136 pounds per yard of length and could have a height of $7\frac{5}{16}$ inches. In other words, there can be more than a two inch difference between the heights of commonly used rails used in the railroad industry.

In addition, commonly known and used transverse, usually wooden, railroad ties which are secured to the rails of a railroad track also vary in lateral width ranging from as wide $9\frac{1}{4}$ inches maximum (nominal width of nine inches) down to a width of $7\frac{3}{16}$ inches (nominal width of seven inches), thereby having as much as about two inches of difference in width between commonly used railroad ties. It is desirable to provide a derail which may be secured to a tie, regardless of the tie's width.

Particularly in the case of derails that are low profile (less than 3 inches above the top of a rail) to avoid being moved out of the operative derail position by the pilot of a moving locomotive, a derail assembly of the low profile type is desirable to be very securely mounted both to the rail and a tie in the area being used so as to be effective in accomplishing the desired derailment of the undesirably moving locomotive, as well as other undesirably moving railway cars.

SUMMARY OF THE INVENTION

The subject of this invention is an improved derail over prior art references, including U.S. Pat. No. 4,165,060, U.S. Pat. No. 6,105,906, U.S. Pat. No. 6,202,564, and U.S. Publication No. 2010/0051757.

The derail discussed herein was designed specifically for low profile use in connection with derailing undesirably moving locomotives having pilots that are only about three inches above the rail's top surface. It is to be understood that the derail to be discussed herein is considered a universal derail that can be used with or without a "low profile", that is, under three inches in height. It can be used in connection with derailing any railway car including heavy locomotives. The present invention is highly versatile since it can be used in connection with standard height derails as well as "low profile" derails, that is, these have less than three inches in height above the rail upon which it is mounted. The derail may be used as a one ended derail as well as a double ended derail for derailing. The double ended derail does not need to be repositioned to be effective for derailing any railway car including a locomotive moving in two directions. The invention as discussed herein includes a system for securing a derail of any type to a single tie which may have widths varying approximately between seven inches and nine inches. The derail includes the ability to be secured to a rail having variable heights, such as between 4 15/16 inches and 7 5/16 inches.

In summary, there is a need in the railroad industry to provide a derail, preferably relatively light in weight, to be portable and yet be effective to derail an undesirably moving locomotive having a weight of several hundred thousand pounds as well as a boxcar or other conventional railway car whether undesirably moving in one direction or the other direction. The derail is exceptionally well secured to a single railroad tie which may have varying widths. The derail assembly may be secured rigidly at multiple locations to rails having heights that may vary, such as between 4 15/16 inches and 7 5/16 inches. The derail height may be constructed to be less than three inches in height above the upper surface of the track to provide a clearance of at least about a 1/4 inch between the lowest point of the pilot of a locomotive and the derail and yet may be built to have a height above three inches if the derailing locomotive is of no concern. There is a need for an improved derail which may or may not be of a low profile type, which may be secured to a rail of varying height, which may be secured to a tie of varying widths, and which may be double ended or single ended which is accomplished by the derail of the present invention.

The derail assembly of the present invention is provided for derailing a wheeled railway vehicle movable along a pair of laterally spaced rails. Commonly, the rails have a field side and a gage side wherein railway ties are securely and transversely mounted against the lower flanges of the rails. The railroad ties have upright side walls and each of the rails has upper and lower flanges interconnected by a central upright rigid unitary support member. The derail assembly includes an elongated, rigid derail plate having an upper side and an under side with the under side being in direct contact with the upper flange of one of the railroad rails. The elongated rigid derail plate has a wheel entrance end and a wheel exit end which is longitudinally spaced from the wheel entrance end. At least one angled upright derail bar is securely mounted on the upper side of the derail plate. A second upright derail bar may be secured on the upper side of the derail plate and be angled in the opposite direction from the one derail bar so as to be a double ended derail. Each of the upright derail bars, if two are being used, are angled outwardly from the wheel entrance end to the wheel entrance end for engaging the wheel of a railed vehicle, such as a locomotive, which is moving undesirably, in one direction or the other, along the rails to thereby cause a desired derailment of the vehicle toward the field side of the undesirably moving vehicle. A pair of longitudinally spaced upright rigid members are secured to the underside of the derail plate. The upright rigid members are transversely spaced from the one rail on the gage side thereof and the upright rigid members are laterally spaced to define an open area between the upright rigid members. The open area has a predetermined lateral distance between the upright rigid members. One of the ties is securely and snugly positioned within the open area and between the upright rigid members with the side walls of one tie being secured between the upright rigid members. Longitudinally spaced hook members are secured to the derail plate at the wheel entrance end and at the wheel exit end. The hook members are secured to the derail assembly on the field side of the one rail. A clamp assembly is secured to the derail plate on the gage side of the rail opposite the hooks. The clamp assembly and the hook members cooperate for assisting in transversely securing the derail assembly to the one rail while the upright rigid members are longitudinally securely positioned between the side walls of the one tie. A spacer bar or bars are interposed in the open area in the event that the railroad tie is more narrow in width than the open area space between the spaced upright rigid members. Further, since each rail flange has a lower flange, to further secure the derail assembly to the bottom flange of the rail, flange feet are rigidly secured to the upright rigid members of the derail and are secured against the upper surface of the bottom flange on the gage side of the railroad tie. The flange feet are adjustably positioned on the upright rigid members to accommodate the variable height of the rail. The improved derail assembly of the present invention is thereby laterally or transversely secured to the rail at five locations, two on the field side of the rail and three on the gage side of the rail even when the rail may vary significantly in height. Further, the derail assembly is longitudinally secured to a single tie created by the snug fit between the upright members only between one upright member and one spacer bar, or between two spacer bars which butt up against the upright members.

These and other advantages and features of the invention will be set forth in the detailed description which follows.

BRIEF DESCRIPTION OF THE DRAWING

The accompanying drawings are incorporated into and are part of the description of the invention. The drawings illustrate certain embodiments of the present invention and serve to explain and describe the embodiments of the invention. The drawings are not to be construed as limiting the scope of the invention, but are intended to assist in the description of the invention.

DESCRIPTION OF EMBODIMENTS OF THE INVENTION

Figure 1:
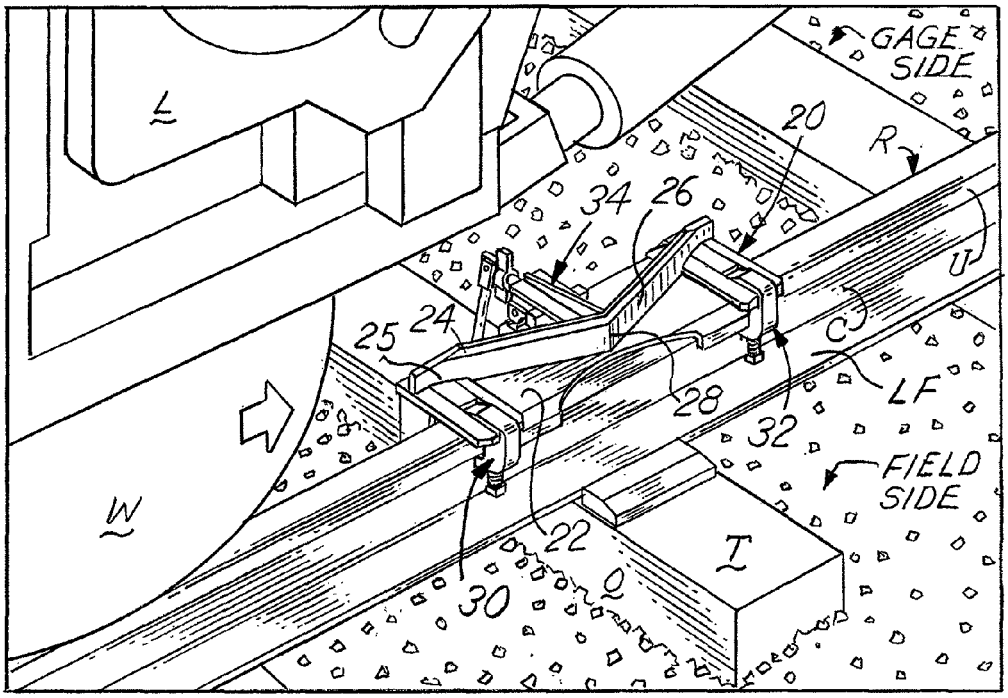
FIG. 1 is an illustration showing the front wheel of an undesirably moving locomotive with a pilot (not shown) located in the front lower portion thereof and showing the derail assembly of the double ended type affixed to one rail while also being affixed to a single tie as a locomotive is undesirably moving on the rails towards the derail assembly of the present invention.
Figure 1A:
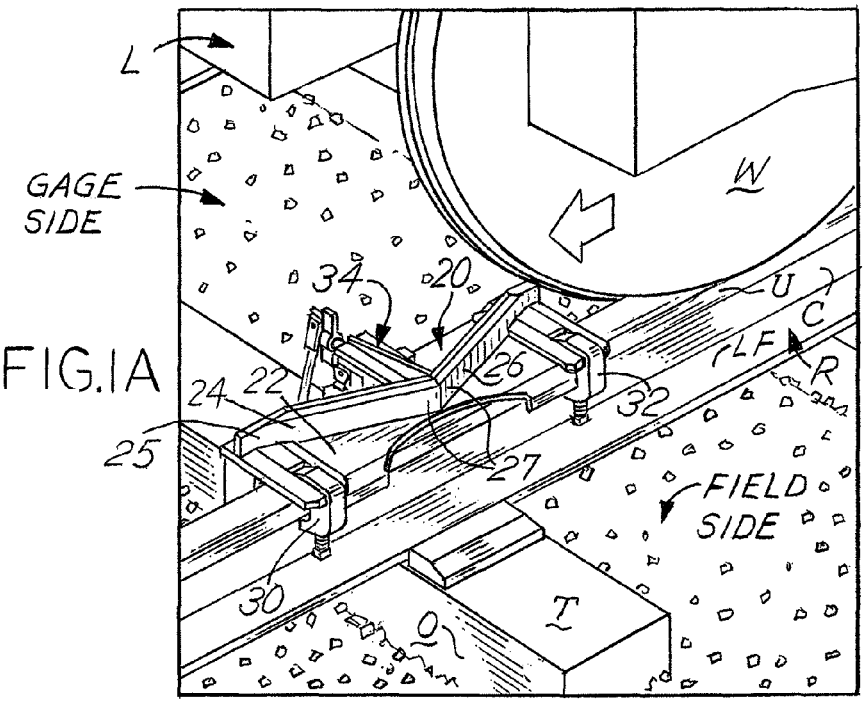
FIG. 1A is an illustration, similar to FIG. 1, except showing the same derail in position on the rail to derail the wheel of a locomotive or other vehicle moving from the opposite direction from that shown in FIG. 1.

Referring to FIGS. 1 and 1A of the drawings, the manner of using the double ended derail assembly, generally 20, is shown. The front of a locomotive L is shown as it moves along a pair of conventionally spaced longitudinal steel railroad track rails R which are fixedly supported in the usual manner upon transverse railroad ties T. The ties T are mounted transverse to the spaced elongated rails (only one rail R being shown in the drawings) upon which a locomotive L is moving. The front lower portion of the locomotive is provided with a pilot (not shown). Further details of the locomotive L and the pilot are shown in U.S. Publication No. 2010/0051757 which is incorporated herein by reference. Relatively new railroad industry specifications allow the lowest point of a pilot to have a clearance of only three inches above the top surface of the rail R. If the locomotive L is moving undesirably, usually at low speeds such as five miles per hour, and possibly above that, the derail assembly 20 must be lower in height, such as 2¾ inches maximum above the top surface of the rail R to provide at least ¼ inch clearance below the lowest point of the pilot and the highest point of the derail 20. Otherwise, the pilot could simply push or force the derail assembly 20 off the rail R upon which the derail is affixed. If this occurs, the derail 20 would not cause the desired derailment of the undesirably moving locomotive.

Referring to FIG. 1, the derail assembly 20 is shown as being securely mounted on one rail R and on one tie T. The derail assembly 20 is positioned so as to cause a desired derailment of the undesirably moving locomotive L to the field side of the spaced rails R. (The field side of spaced rails R is the space away from the set of rails while the gage side of the rails R is the space between the rails R as seen in FIGS. 1 and 1A).

Referring to FIG. 1A, a wheel W of a locomotive L is shown moving in the opposite direction from the movement as shown in FIG. 1. As indicated above, a double ended derail assembly 20 is fixedly secured to one rail R and to one tie T so that the derail 20 is effective in derailing the undesirably moving locomotive L or other railway car whether moving in one direction or in the opposite direction. It is to be understood, however, that a single ended derail assembly (not shown herein but shown in U.S. Publication No. 2010/0051757) may also be used for carrying out the invention described herein.

Referring to FIGS. 2-5, the derail assembly 20 is shown mounted upon one rail R. The rail R includes an upper flange U and a lower flange LF which are interconnected in a conventional manner by unitary upright unitary center portion C. The railroad tie T has a top surface S and laterally spaced outer side walls O.

Figure 2:
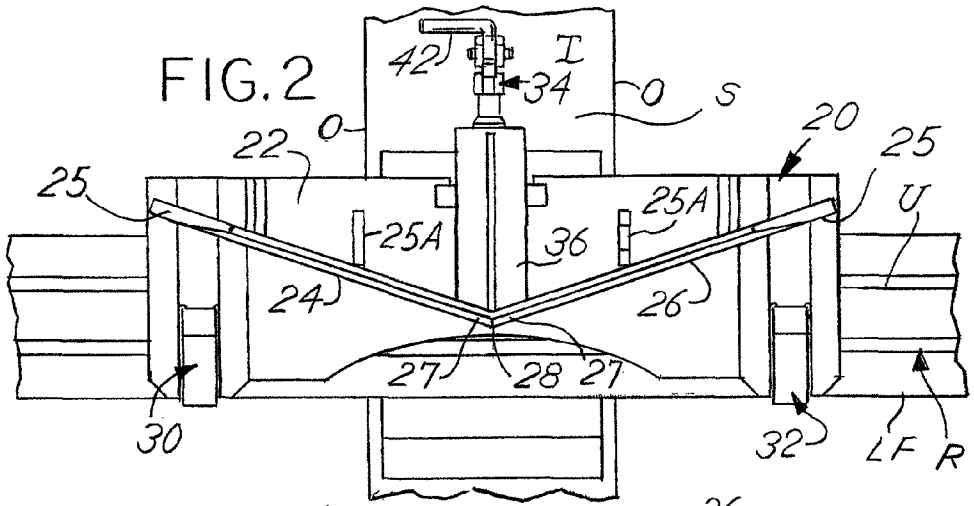
FIG. 2 is a top plan view of the derail assembly of the present invention showing a double ended derail mounted on one railroad rail and on one railroad tie.
Figure 4:
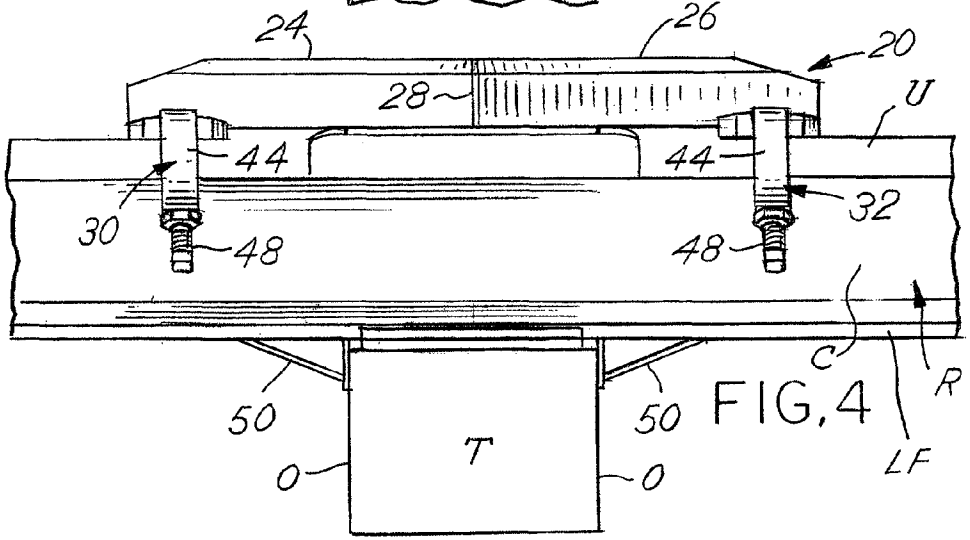
FIG. 4 is a field side view of the derail assembly shown in FIGS. 2 and 3.
Figure 5:
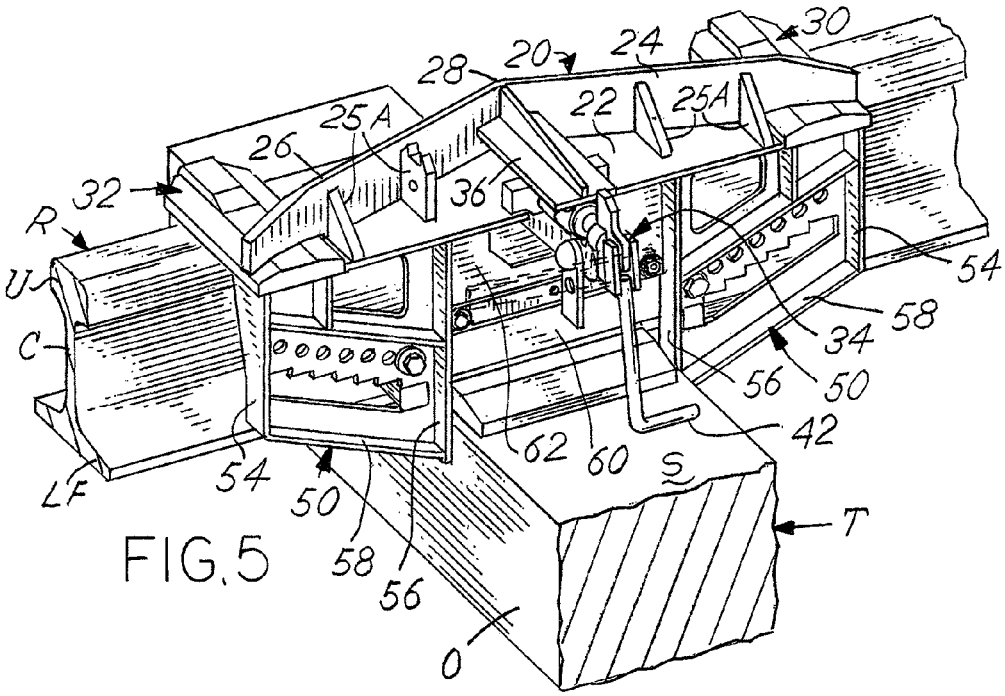
FIG. 5 is a perspective view showing a double ended derail assembly mounted on a single tie and on one rail, as seen from the gage side of the railroad tracks.
Figure 7:
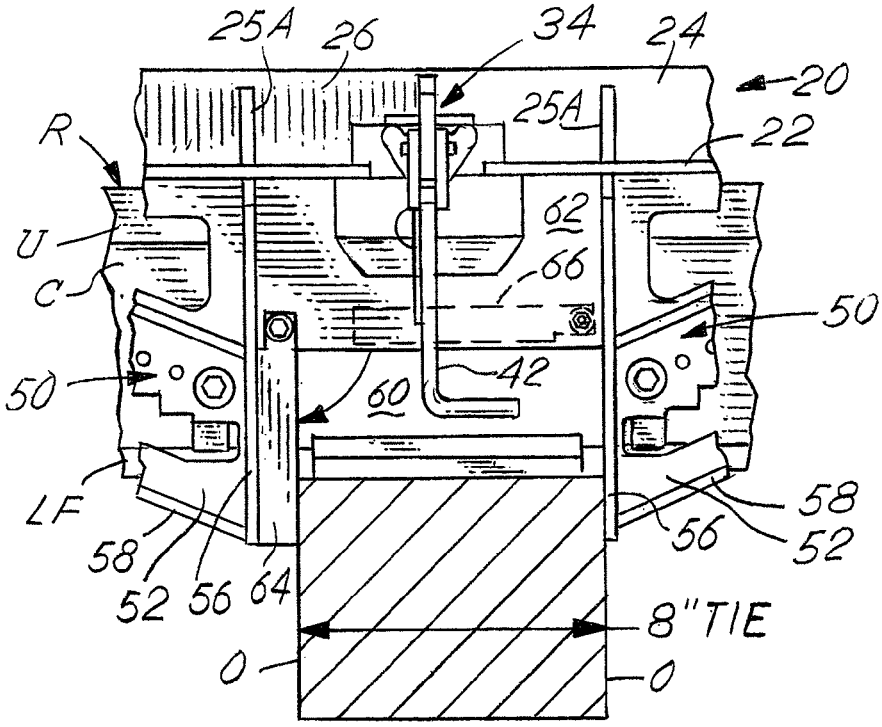
FIG. 7 is a view similar to FIG. 6 showing the use of a single spacer bar located on one side of a nominal eight inch wide railroad tie.
Figure 8:
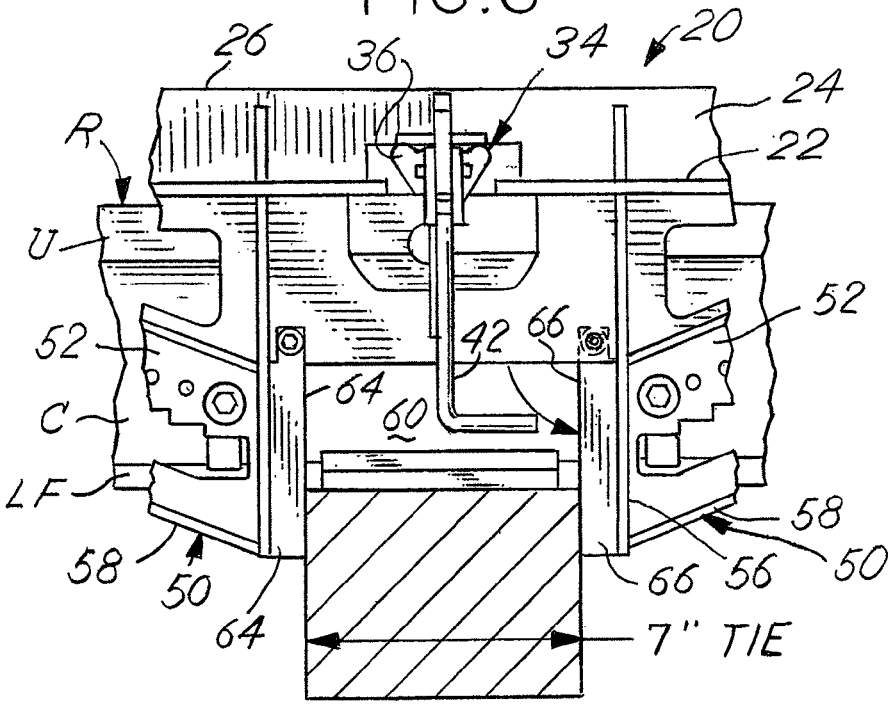
FIG. 8 is a view similar to FIGS. 6 and 7 showing two spacer bars being in position against the opposite sides of a nominal seven inch wide railroad tie.
Figure 10:
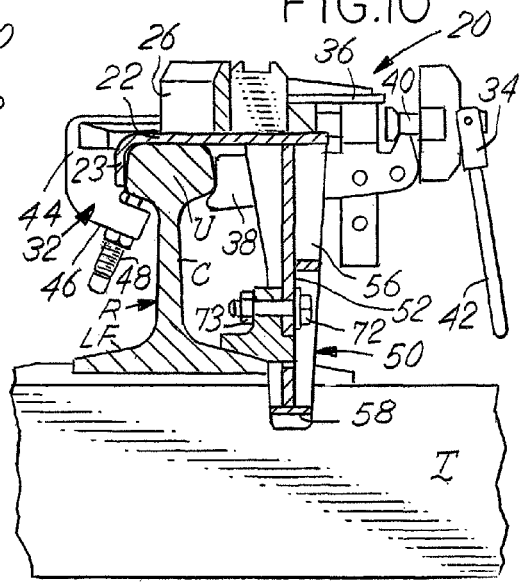
FIG. 10 is a sectional view of the derail assembly taken along the line 10-10 of FIG. 9 showing a flange foot in cross section bearing against the bottom flange of a railroad rail.
Figure 11:
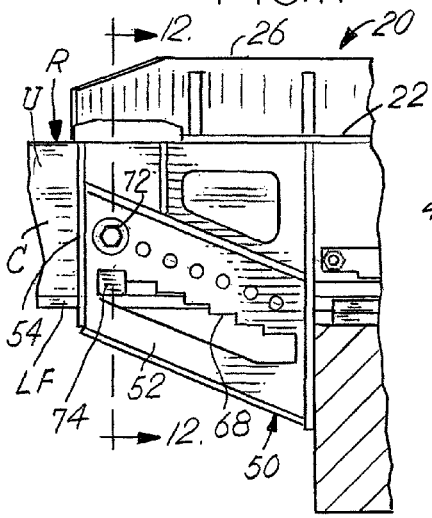
FIG. 11 shows a view similar to FIG. 9 in the case of a shorter railroad rail such as approximately five inches.

The derail assembly 20 includes a rigid derail shoe or plate 22 which is mounted directly upon and substantially completely covers the entire top surface S of the upper flange U of the rail R. Referring to FIG. 10, the derail plate 22 includes a downwardly directed, unitary flange 23 which extends along the outer wall of the upper flange U of the rail R. The flange 23 significantly enhances the strength of the derail plate 22, particularly when the derail assembly 20 derails a locomotive L. A first wheel deflecting bar 24 is rigidly mounted at an angle to the derail plate 22 and is effective to engage the wheel W, as shown in FIG. 1, of an undesirably moving locomotive L moving in a first direction. The deflecting bar 24 is in a substantially upright or vertical position on the upper surface of the derail plate 22. Referring to FIG. 1, the bar 24 is mounted at an angle effective to engage the locomotive's wheel W on the field side as shown in FIG. 1 wherein the lead wheel W of the moving locomotive L approaches the deflecting bar 24. The undesirably moving locomotive L (or other railroad vehicle), which is moving along the rails R, is in position to have the wheel W engage the deflecting bar 24 and derail the locomotive L by deflecting the wheel W from the entrance end 25 to the exit end 27 of the deflecting bar 24 towards the field side of the railroad tracks. The deflecting bar 24 is preferably angled outwardly from the entrance end 25 to the exit end 27 of the deflecting bar 24 at between 11° and 28°. Referring to FIGS. 2, 5 and 7, upright support plates 25A are welded to the upper surface of the deflecting plate and are also welded to the gage side of the deflecting bar 24 for providing added rigid support of the bar 24 during derailing.

Referring to FIG. 1A, the derail assembly 20 is shown in the drawings to be a double ended type of derail. In the double ended derail, a second deflecting bar 26 is angled in the opposite direction from the adjacent derail bar 24 to deflect the wheel W of an oppositely moving locomotive L or other railway vehicle to deflect the wheel W and thereby cause derailment of the undesirably moving locomotive L or other type of railway car. The deflecting bar 26 has an entrance end 25 and an exit end 27. The deflecting bar 26 is also positioned in a second substantially upright position and is secured to the plate 22 by welding. The deflecting bars 24 and 26 are rigidly secured together, as by welding, at a rigid mating joint 28. While a double ended derail assembly 20 is shown in the drawings, it is to be understood that a single ended deflecting bar (not shown) may be provided, as shown in Publication No. U.S. 2010/0051757.

The derail assembly 20 further includes a pair of derail hooks 30 and 32 which transversely secure the derail assembly 20 to the rail R. The derail hook 30 is positioned at the entrance end 25 of the first deflecting bar 24 while the derail hook 32 is affixed to the entrance end 25 of the second deflecting bar 26. The exit ends 27 of both derail hooks 30 and 32 are located at the upright welded joint 28 attaching the deflecting bars 24 and 26 together. The derail hooks 30 and 32 are provided with set screws 48 which secure both hooks 30 and 32 to the upper rail flange U along the field side.

Figure 3:
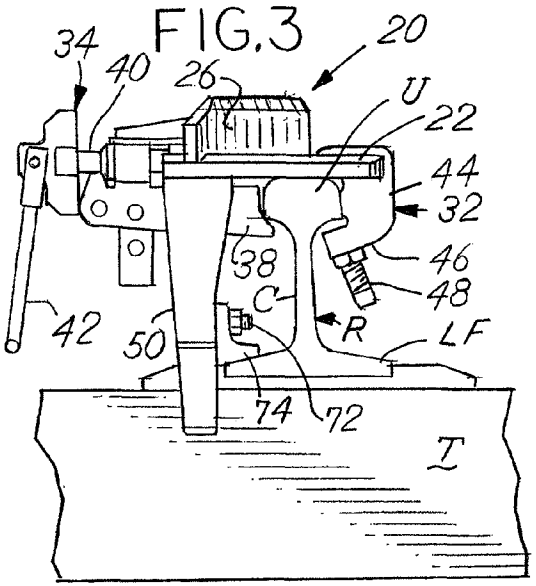
FIG. 3 is an end elevational view of the derail assembly embodied in FIG. 2.

The derail assembly 20 further includes an adjustable clamp assembly, generally 34, which is secured to the deflecting plate 22 by a support member 36. The clamp assembly 34 includes a rigid transverse wedge shaped member 38, as viewed best in FIGS. 3, 10 and 12, which is designed to bear against the upper rail flange U on the gage side of the rail R. The clamp assembly 34 also includes a threaded rotatable shaft 40 which is threadably received by a clamp support 36 which is secured to the plate 22. The outer end of the threaded shaft 40 is connected to a crank arm 42 which is rotatably operated to move the shaft 40 to force the wedge 38 against the upper flange U for added securement to the rail R. The adjustable clamp 34 and specifically the wedge 38, as seen in FIG. 3, cooperate with the derail hooks 30 and 32, to rigidly and transversely secure the derail assembly 20 to the rail R. The clamp assembly 34 secures the assembly 20 to the rail R frame, the gage side and the hooks secure the derail assembly 20 to the rail R at the field side.

The design of the derail hooks 30 and 32 are substantially in accord with that shown in U.S. Publication No. 2010/0051757. As seen best in FIGS. 3, 10 and 12 hereof, the hooks 30 and 32 each have downwardly directed portion 44 and a rail facing slightly downwardly angled portion 46. Each of the angled portions 46 are threaded to receive the threaded set screw members 48 which bear upwardly against the lower portion of the upper flange U. In this way, the clamp assembly 34 and the spaced derail hooks 30 and 32 cooperate to rigidly and transversely secure the derail assembly 20 to opposite sides of the upper flange U of the railroad rail R. As will be described, further additional securement is provided for securing the derail assembly 20 to the rail R.

Figure 6:
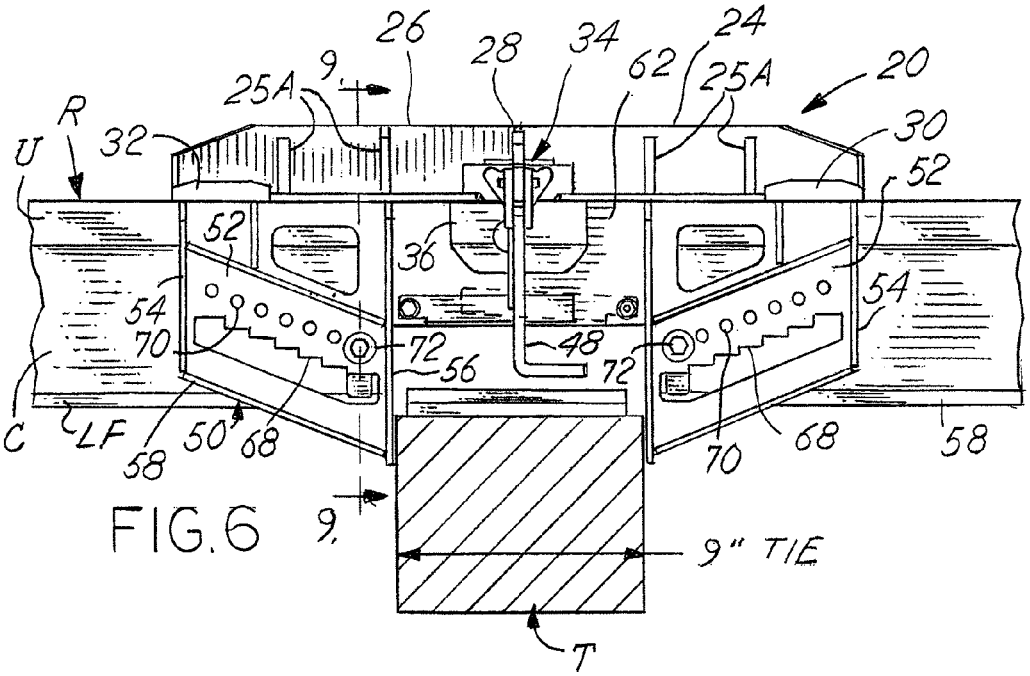
FIG. 6 is a partially sectional elevational view from the gage side of the derail assembly shown in FIGS. 2-5 mounted on a nominal nine inch wide railroad.

Referring particularly to FIGS. 5 and 6, a pair of laterally spaced, upright rigid support members generally 50, which are substantially mirror images of each other, are securely mounted, as by welding, to the underside of the gage side of the derail plate 22 of the derail assembly 20. Each upright support member 50 includes a central upright portion 52 laterally spaced from the rail R on the gage side of the rail R. Each upright support 50 includes a transverse outwardly facing outer flange 54 and an inwardly facing inner flange 56. The lower edge of each upright central portion 52 includes an upwardly angled lower flange 58 which interconnects the outer and inner flanges 54 and 56. The inner flanges 56 of the upright supports 50 face each other and define an open space 60 therebetween. As seen best in FIGS. 5-8, the railroad tie T is positioned within the open space 60 and is positioned therebetween whether tie T has nominal widths of seven, eight, or nine inches. The open space 60 shown in FIG. 6 has a nominal width of nine inches between the inner flanges 56, which is the nominal width of a widest wood tie T. Again, referring to FIGS. 5-8, a central upright transverse plate 62 is welded in position above the open space 60 and is rigidly secured by welding to the lower side of the deflecting plate 22 and also to the inwardly facing flanges 56 of the upright supports 50 thereby providing rigidity to the spaced upright rigid supports 50.

With particular reference to FIGS. 5-8, a first rotatable spacer bar 64 and a second rotatable spacer bar 66 are rotatably carried at the lower, spaced outermost corners of the transverse central plate 62 adjacent the inner facing flanges 56 of the upright supports 50. It is known in the railroad industry that wood railroad ties T have nominal widths of nine inches, eight inches, and seven inches. Referring to FIG. 6, there is a cross sectional view showing a nine inch railroad tie T that is positioned snugly between the inner facing flanges 56 of the upright supports 50. Referring to FIG. 7, when a tie T is eight inches in nominal width, the outer side spacer bar 96 is rotated downwardly to an upright position as shown in FIG. 7. The tie T is snugly positioned between the spacer bar 64 and one inner flange 56 of the spaced upright support 50. Similarly, in the case of a seven inch width tie, two spacer bars 64 and 66 are rotated downwardly so each of the spacer bars 64 and 66 fit snugly up against a seven inch railroad tie T. The combination of the open space between the flanges 56 provides significantly versatility of securing the derail assembly 20 to a single railroad tie T by the use of compensating spacer bars 64 and 66 which may be positioned so that a snug is provided for the tie T between one or two flanges by use of the spacer bars 64 and 66. Each spacer bar 64 and 66 has a width of approximately one inch.

Although the railroad tie T discussed herein primarily relates to wooden ties of the type commonly used when laying railroad track in the United States, steel railroad ties and concrete railroad ties are also used. With possible detailed changes in the design of the derail assembly 20, it is contemplated that the use of a derail 20 of the type designed herein can also be secured to concrete and steel railroad ties (not shown).

Figure 9:
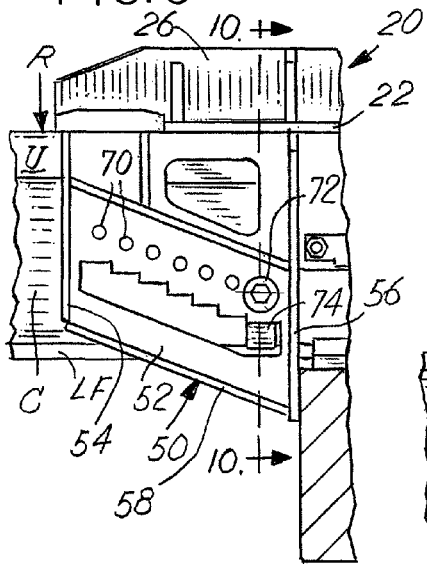
FIG. 9 is a partial sectional view of the derail assembly taken along the line 9-9 of FIG. 6.

As indicated previously, provision is made for additional transverse support of the derail assembly 20 to the rail R. Referring specifically to FIGS. 9-12, the central upright portion 52 of each of the upright supports 50 includes multiple upwardly angled steps 68 and multiple upwardly angled openings 70 for receiving a rigid bolt 72 and nut 73. FIGS. 9 and 10 show a railroad rail R of a relatively high height, such as approximately seven inches. A rigid foot member 74 is bolted to the lowermost, innermost opening 70 and secures the foot member 74, which is angled to bear down against the upper surface of the lower rail flange LF. In a similar manner, in the case of a lower rail R, such as five inches, the foot member 74 is again secured by a nut 73 and bolt 72 to the uppermost and outermost of the openings 70 spaced along the support portion. The outwardly facing rear side of the foot member 74 is relatively square in cross section and is snugly received within one of the steps 68 of the central upright portion 52 of the upright supports 50. In this way, the spaced foot members 74, located in the gage side, cooperate with the wedge 38 of the clamp 34, also on the gage side, and with the threaded bolt members 48 and hooks 30 and 32, that are secured to the underside of the upper flange U of the rail on the field side. As described, strong attachment is provided to laterally or transversely secure derail assembly 20 to the rail R at three separate locations on the gage side of the rail R by the clamp wedge 38 and the two foot members 74 and on the field side by the two hook members 30 and 32.

As can be seen by the above description of the preferred embodiment of the present invention, a very versatile derail assembly 20 has been described. The derail assembly 20 may be double ended or single ended so as to be effective in derailing any type of undesirably moving railroad car, including a heavy locomotive, whether moving in one direction or the other. In the case of a double ended derail as shown in FIGS. 1 and 1A, the derail assembly 20 is effective to derail a heavy locomotive moving from two directions without resetting the derail 20. The derail 20, as described, does not need to be repositioned regardless of the direction of movement of a locomotive L or other railway car that is undesirably moving. In the case of an undesirably moving locomotive L, the derail is desirably a low profile derail which is no more than approximately 2¾ inches measured above the rail R to the uppermost portion of the derail 20 to thereby assure that the pilot of an undesirably moving locomotive L clears the derail assembly 20 so as to avoid undesirable dislodgement of the derail assembly 20 from the rail before the derail 20 is able to engage a wheel W of the locomotive L to cause the desired derailment.

The derail 20, as described, has a five point lateral or transverse securement of the derail 20 to a rail R. In this regard, the wedge 38 of the clamp 34 engages the rail R or the gage side of the rail while the upper flange U is engaged at two positions on the field side by the hook members 30 and 32 which engage the upper flange of the rail R at two locations. Finally, the foot members 34 engage the lower flange LF of the rail R on the gage side of the rail R. Not only is the derail assembly 20 laterally or transversely secured by five points to the rail R, the derail assembly 20 is longitudinally secured to one tie T by snugly positioning the tie T regardless of its nominal width (7", 8" or 9"). None, or one or two 1" spacer bars 64 and 66 are used to provide a snug longitudinal fit between the derail assembly 20 and the tie T. In the case of a double ended derail, this snug support of the derail relative to the frame is particularly important in further avoiding longitudinal movement of the derail 20 along the rail R as in the case of a heavy locomotive moving from opposite directions and regardless of the five point transverse or longitudinal connection between the derail 20 and the rail R.

Figure 12:
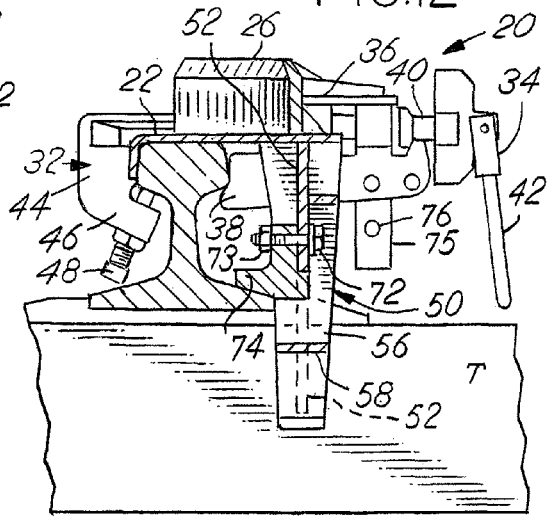
FIG. 12 is a cross sectional view similar to FIG. 9 of a shorter railroad rail and the changed position of the flange foot bearing against the upper side of the bottom flange of the railroad rail.

When installing the derail assembly 20 on a rail R and on a tie T, an operator first loosens the set of screws 48 positioned in the angled portion 46 of the two derail hooks 30 and 32. Further, the crank arm 42 is operated to loosen the clamp 34 and the wedge 38. The derail assembly plate 32 is then placed on top of a rail R. Once the assembly 20 is loosely in position, the next step is to position the foot members 74 on the lower rail flange LF engaging position of in FIGS. 10 and 12. This allows the derail 20 to be level and parallel to the rail R. The foot members 74 are then secured in place on the lower flange LF of the rail R by the bolt 72 and nut 73. The derail 20 is also centered over a tie T. A determination is made as to the width of the tie T. The spacer bars 64 and 66 may both be raised, one may be lowered, or neither may be lowered, depending on whether the tie T is a nominal seven inches, eight inches, or nine inches in width. If one or two spacer bars 64 and 66 need to be pivoted downwardly to provide a snug fit between one spacer bar 66 and one of the flanges 56 or both of the flanges 56, the spacer bars 64 and 66 are tightened in place. Any unused spacer bar is rotated upwardly to a horizontal position and secured to the central plate 62. The clamp adjustment crank arm 42 is finally operated to move the wedge 38 against the upper flange U as seen in FIGS. 3, 10 and 12. If desired, a padlock (not shown) may be inserted into the holes 76 on the upright arm 75 and holes 76 are aligned. Finally, a warning flag (not shown) may be mounted on the derail assembly 29, if desired.

While in the foregoing, there has been provided a detailed description of embodiments of the present invention, it should be recognized to those skilled in the art that the described embodiments may be altered or amended without departing from the spirit or scope of the invention defined in the accompanying claims.

What is claimed is:

1. A derail assembly for derailing a wheel of a wheeled railway vehicle movable along a pair of laterally spaced rails, said rails having a field side and a gage side, wherein railroad ties are securely and transversely mounted on said rails, each of said ties having upright side walls, each of said rails having upper and lower flanges interconnected by a central upright unitary support, said derail assembly comprising, in combination, an elongated rigid derail plate having an upper side and an under side, said under side being in direct contact with said upper flange of one of said rails, said elongated rigid derail plate having a wheel entrance end and a wheel exit end and being longitudinally spaced from said wheel entrance end, an upright derail bar which is securely mounted on the upper side of said derail plate, said upright derail bar being angled outwardly from said wheel entrance end to said wheel exit end for engaging a wheel of said vehicle when moving undesirably along said rails to thereby cause desired derailment toward said field side of said undesirably moving vehicle, a pair of longitudinally spaced upright rigid members secured to the under side of said derail plate, said upright rigid members being transversely spaced from said one rail on the gage side thereof, said upright rigid members defining an open area between said upright rigid members, said open area having a predetermined lateral distance between said upright rigid members, one of said ties being positioned within said open area and between said upright rigid members, said side walls of said one tie being secured between said upright rigid members, longitudinally spaced hook members secured to said derail plate at said wheel entrance end and at said wheel exit end, said hook members securing said derail assembly on the field side of said one rail, and a clamp assembly secured to said derail plate on said gage side of said one rail opposite said hook members, said clamp assembly and said hook members cooperating for assisting in securing said derail assembly to said one rail while said upright rigid members are securely positioned between said side walls of said one tie.

2. The derail assembly of claim 1 including a pair of spaced foot members secured to each of said upright rigid members, each of said foot members bearing against the lower flange of said one rail on the gage side thereof, said foot members, said clamp assembly, and said hook members cooperating to laterally secure said derail assembly to said rail.

3. The derail assembly of claim 1 wherein said railroad tie has a first lateral distance between said upright sidewalls that is less than the predetermined lateral distance between the upright rigid members, and at least one spacer member moveable between operative and inoperative positions on said assembly for positioning said at least one spacer member when in an operative position being in said open space adjacent at least one side wall of said tie and against one of said upright rigid members to provide a snug fit of said railroad tie between at least one of said spacer members and one of said upright rigid members to secure said derail assembly against longitudinal movement.

4. The derail assembly of claim 3 including a second moveable spacer member mounted on said derail assembly and being moveable between operative and inoperative positions, said first and second moveable spacer members being positioned in said open space so that the upright side walls of said tie are snugly positioned between said first and second moveable spacer members for providing a snug fit of said railroad tie between said two spacer members.

5. The derail assembly of claim 1 wherein a second upright derail bar is securely mounted on the upper side of said derail plate, said second upright derail bar being angled outwardly from the wheel entrance end to said wheel exit end and wherein said wheel exit ends of said first upright derail bar and said second upright derail bar are rigidly secured at a joint, said second derail bar being angled to engage a wheel of an oppositely moving wheeled railway vehicle.

6. The derail assembly of claim 1 wherein said derail assembly has a maximum height of about 2¾ inches above the upper surface of said rail.

7. In a derail assembly for derailing a wheel of a wheeled railway vehicle moveable along a pair of laterally spaced rails, wherein said rails have a field side and a gage side, wherein at least one railway tie is securely and transversely mounted on said rails, said tie having upright side walls, and each of said rails having upper and lower flanges, the derail assembly is of the type that includes an elongated rigid derail plate mounted against one of said rails wherein the improvement comprises a securement structure for mounting said derail assembly on one tie for preventing undesirable movement of said derail assembly against longitudinal movement in two directions on one of said rails, said securement structure comprising, in combination:

a pair of longitudinally spaced upright rigid members secured to the underside of said derail plate, said upright rigid members being positioned on the gage side of said derail assembly, said upright rigid members defining an open area between said upright rigid members, said open area having a predetermined lateral distance between said upright rigid members, said one tie being positioned within said open area and between said upright rigid members, said side walls of said one tie being snugly secured between said upright rigid members.

8. The securement structure of claim 7 including a pair of longitudinally spaced hook members secured to said derail plate, said hook members securing said derail assembly to said rail on said field side of said rail at first and second securing positions, a clamp assembly secured to said derail plate on said gage side of said rail opposite said hooks at a third securing position, and a pair of spaced foot members secured to each of said upright rigid members and bearing against the lower flange of one rail on the gage side thereof at fourth and fifth spaced positions, whereby, transverse securement of said derail assembly to said rail is provided on both the gage side and the field side of said one rail at said five positions.

9. The derail assembly of claim 8 wherein said railroad tie has a first lateral distance between said upright side walls that is less than the predetermined lateral distance between the upright rigid members, and at least one moveable spacer member mounted on said assembly and moveable between operative and inoperative positions for positioning said at least one spacer member in an operative position in said open space against at least one side wall of said tie and against one of said upright rigid members to provide a snug fit of said railroad tie between at least one of said spacer members and one of said upright rigid members to secure said derail assembly against longitudinal movement.

* * * * *